United States Patent [19]

Grzina

[11] Patent Number: 4,566,850

[45] Date of Patent: Jan. 28, 1986

[54] PUMP

[75] Inventor: Anthony Grzina, Artarmon, Australia

[73] Assignee: Warman International Limited, Australia

[21] Appl. No.: 606,271

[22] Filed: May 2, 1984

Related U.S. Application Data

[63] Continuation of Ser. No. 184,075, Sep. 4, 1980, abandoned.

[30] Foreign Application Priority Data

Sep. 7, 1979 [AU] Australia ..... PE0412

[51] Int. Cl.[4] ..... F04D 7/06; F01D 25/26

[52] U.S. Cl. ..... 415/128; 415/136; 415/196

[58] Field of Search ..... 415/128, 196, 113, 134, 415/135, 136, 137, 219 R, 197, 138

[56] References Cited

U.S. PATENT DOCUMENTS

| | | | |
|---|---|---|---|
| 666,234 | 1/1901 | McRae | 415/219 C |
| 797,058 | 8/1905 | Hedlund | 415/196 |
| 888,814 | 5/1908 | Jones | 415/197 |
| 1,527,635 | 2/1925 | Doran | 415/219 C |
| 1,671,054 | 5/1928 | Welsh | 415/219 C |
| 1,925,148 | 9/1933 | Lysholm | 415/136 |
| 1,958,108 | 5/1934 | Milkowski | 415/196 |
| 2,163,464 | 9/1939 | Llewellyn | 415/197 |
| 2,365,058 | 12/1944 | Crawford | 415/197 X |
| 2,800,084 | 7/1957 | Butler | 415/197 X |
| 3,183,841 | 5/1965 | Gaynor | 415/196 X |

FOREIGN PATENT DOCUMENTS

| | | | |
|---|---|---|---|
| 493280 | 2/1950 | Belgium | 415/128 |
| 1004201 | 3/1957 | Fed. Rep. of Germany | 415/219 R |
| 1055549 | 4/1959 | Fed. Rep. of Germany | 415/219 R |

*Primary Examiner*—Robert E. Garrett
*Assistant Examiner*—Joseph M. Pitko
*Attorney, Agent, or Firm*—Henry M. Bissell

[57] ABSTRACT

A pump comprising an outer casing, an inner liner and a rotatable impeller, the liner being mounted to the casing in a manner such that the liner is substantially secured against rotational movement within the casing but can expand, contract or deflect radially from the centerline of rotation of the impeller.

12 Claims, 3 Drawing Figures

II
6

2
1
9
5
4
7
4
5
II

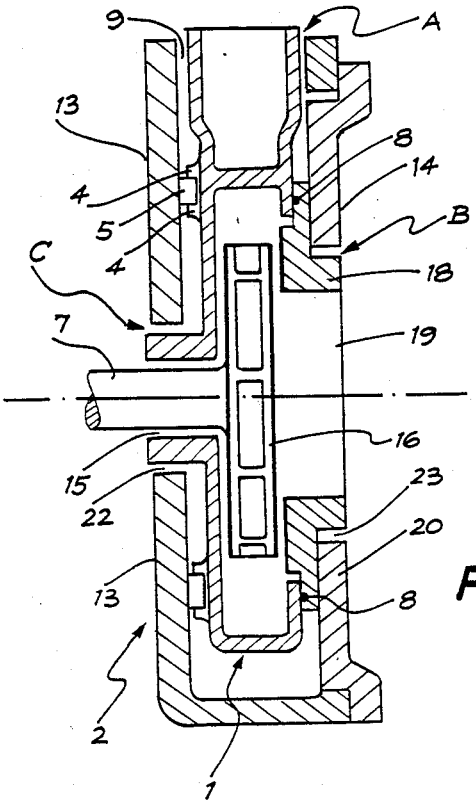
FIG. 2
FIG. 3
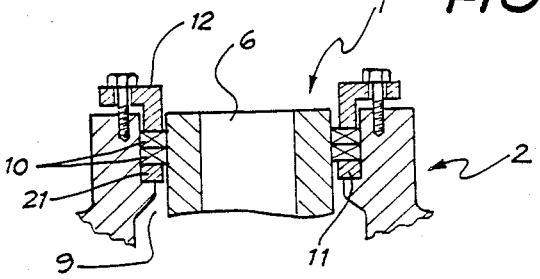

PUMP

This is a continuation of application Ser. No. 184,075, filed Sept. 4, 1980, now abandoned.

The present invention relates to an improved pump and in particular to an improved centrifugal pump containing an inner liner.

The present invention provides a pump arrangement in which the liner is securely held within the casing against rotational movement, and the liner is centralized such that it can only be secured in the one position within the casing but with freedom to expand, contract or deflect radially from the centreline of rotation of the impeller. The present invention is suitable for any type of lined pump.

In one broad form the invention comprises a pump containing an outer casing, an inner liner and affixing means whereby the liner is maintained in said housing and substantially secured against rotational movement within said casing.

The present invention is particularly useful in any lined pump wherein rotational movement of the liner is undesirable or in lined pumps in which thermal expansion or contraction or pressure deflection must be allowed between the liner and the casing. The present invention also is applicable where it is required to pressurise the volume between the casing and the liner so as to provide an equalising pressure to that pressure of the material being pumped or where it is necessary to heat or cool the liner.

The present invention will now be described with reference to the accompanying drawings in which FIG. 1 shows a schematic cross-section through one embodiment of the present invention;

FIG. 2 is a sectional view taken along line II—II of the pump of FIG. 1; and

FIG. 3 shows a sectional detailed view of the arrangement of the outlet of the liner and the outlet of the casing.

Figure 1:
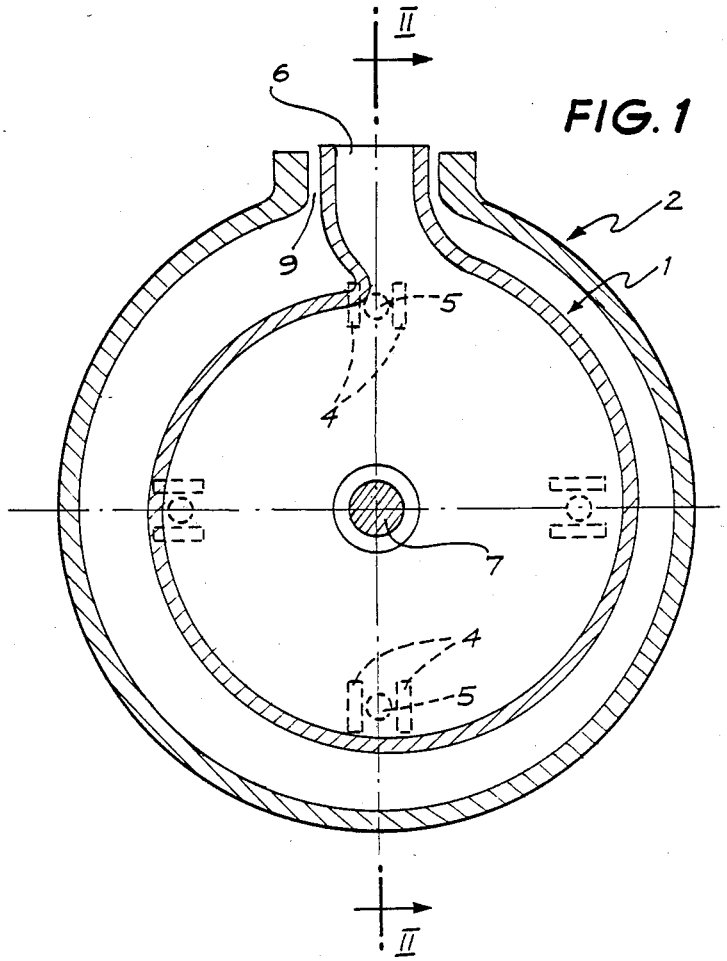

A sectional view is shown in FIG. 1 of one embodiment of the present invention wherein a liner 1 is contained within a circular housing 2.

In this embodiment four keyways 4 are carried on the volute liner 1 and the casing 2 carries complementary pins 5 which fit into the keyways 4 to retain the liner 1 in its desired position within the casing 2. The embodiment shown in the figures has a radial outlet 6 and a generally radially directed rear casing wall 13 on which the complementary pins 5 are mounted, projecting axially from the rear casing wall 13. The corresponding keyways 4 are mounted to project axially from a generally radially directed rear wall of the liner on the side which faces the rear casing wall 13. The use of the radial outlet 6 and the radially aligned keyways 4 and pins 5 in the rear wall portions around the impeller shaft 7 allows the embodiment shown to be used in high or low temperature and pressure work as the liner 1 and the casing 2 are able to expand or contract radially from the centreline of rotation of the impeller without any undue restriction.

FIG. 3 shows the arrangement of the outlet 6 of the liner 1 and the outlet 9 of the casing 2, which allows expansion of the liner outlet 6 within the outlet 9 of the casing 2. A gland packing 10 sits within the opening 9 of the casing 2 and rests upon a neck ring 21 which abuts against the shoulder 11 within the outlet 9 of the casing 2. This gland packing 10 is held in position by a gland ring 12 which is bolted onto the casing outlet 9. The outlet 6 of the liner 1 extends through the gland packing in a pressure tight relationship, such that the gland outlet is able to freely expand in a radial direction, which when the outlet 6 of the liner 1 expands laterally it abuts against and presses the gland packing 10. The arrangement shown in FIG. 3 is a stationary seal which is positioned in the areas marked A, B, C between the casing and the liner.

As shown in FIG. 2 the pump casing 2 has substantial flat sides 13 and 14. The side 13 has a hole 22 therein, while the other side 14 contains the opening 23 through which the liner 1 is inserted within the casing 2. The liner 1 has an opening 15 therein through which the shaft 7 is inserted and connected to the impeller 16.

An annular gate 18 is fitted onto the liner 1 to close the liner, while providing an inlet opening 19. The casing 2 has a gate structure 20 which is bolted or affixed by any suitable means to the casing to seal the casing 2 and to hold the liner gate 18 securely against the liner 1 while providing access to the liner inlet 19.

The liner gate 18 is sealed against liner 1 by any suitable face seal. One embodiment could be an O-ring 8 in a circumferential groove in one of the mating faces, as shown in FIG. 2.

In the embodiment described, the liner 1 is shown with only one gate 18 on side 14. A similar gate could also be provided on side 13 of the liner.

In the embodiment shown in the drawings the affixing means is shown as keyways located on the liner with pins located on the casing. However, it should be realised that any number of affixing means could be used whereby the keyways are either affixed to the liner or to the casing and the pins could either be an elongated key or groups of pins or a single pin.

The hole 15 between shaft 7 and liner 1 may be sealed by any suitable known means such as gland packing or mechanical seal.

The hole 22 between liner 1 and casing 2 on side 13 and the hole 23 between gate 20 on side 14 may in one embodiment be sealed by means of suitable gland packing as shown in FIG. 3.

I claim:

1. A pump comprising an outer casing, an inner liner, a rotatable impeller mounted on a central shaft and means for affixing the liner within the casing to substantially secure the liner against rotational movement within said casing while providing clearance for the liner to expand, contract and deflect radially from the centreline of rotation of the impeller;

said affixing means comprising at least three sets of two radially aligned, axially extending projections located on one of the facing surfaces of the liner and the casing adjacent the ingress of the shaft of the impeller with corresponding mating, axially extending projections on the other of said facing surfaces, each mating projection being adapted to slidably fit between a corresponding set of two radially aligned, axially extending projections.

2. A pump comprising:

an outer casing;

an inner liner;

an impeller received within said casing and liner, said impeller being mounted for rotation therein by means of a shaft extending through central openings in said casing and liner, said casing and liner having generally parallel facing wall surfaces surrounding said central openings and extending radially therefrom; and affixing means for maintaining the liner in said casing and substantially secured against rotational movement within said casing with freedom to expand, contract or deflect radially from the centreline of rotation of the impeller, said affixing means comprising at least three sets of two radially aligned, axially extending projections located on one of the facing wall surfaces of the liner and the casing adjacent the ingress of the shaft of the impeller with a mating projection on the other of said surfaces adapted to slidably fit between each set of two radially aligned, axially extending projections.

3. A pump comprising:

an outer casing;

an inner liner, the casing and liner having generally radially directed facing surfaces on one side thereof;

an impeller received within said casing, said impeller being mounted for rotation within said casing by means of a shaft extending through said casing; and affixing means for maintaining the liner in position in said casing and substantially secured against rotational movement within said casing with freedom to expand, contract or deflect radially from the centreline of rotation of the impeller, said affixing means comprising at least three radially aligned, axially extending keyways located on one of the facing surfaces of the liner and the casing adjacent the ingress of the shaft of the impeller with a corresponding key projecting axially from the other of said facing surfaces and adapted to fit slidably within its associated keyway.

4. The pump of claim 3 wherein said liner has an outlet radially extending with respect to the centreline of rotation of the impeller.

5. The pump of claim 4 further including means for sealing external openings between said liner and said casing, said sealing means comprising a gland holding in position gland packing supported by a gland ring abutting against a shoulder in the casing.

6. The pump of claim 3 wherein said liner has an outlet radially extending with respect to the centreline of rotation of the impeller and wherein an opening is located in the pump casing for the insertion of the liner into the casing opposite the shaft side of the casing, said liner defining an opening located in the same side as the opening of the pump casing, large enough to receive the impeller; the pump further including a liner gate for sealing the liner while providing an inlet to the liner; and wherein the casing comprises a removable gate member which securely locks the liner gate to the liner and secures the liner within the casing.

7. The pump of claim 6 further including means for sealing external openings between said liner and said casing, said sealing mens comprising a gland holding in position gland packing supported by a gland ring abutting against a shoulder in the casing.

8. The pump of claim 3 further including means for sealing external openings between said liner and said casing, said sealing means comprising a gland holding in position gland packing supported by a gland ring abutting against a shoulder in the casing.

9. The pump of claim 3 wherein said generally radially directed surfaces of said casing and liner comprise back wall portions thereof surrounding the impeller shaft.

10. The pump of claim 9 wherein the keyways are mounted on the back wall of the liner to project axially therefrom, each of said keyways defining a slot which is radially directed along said liner back wall for slidably receiving a corresponding key.

11. The pump of claim 10 wherein each key is mounted along the inner surface of the casing back wall and projects axially therefrom in a position to slidably mate with a corresponding keyway.

12. The pump of claim 9 wherein said back wall portions are generally planar and extend orthogonally about said shaft and wherein said keys and keyways project from the facing surfaces of said back wall portions toward each other in a direction generally parallel to said shaft.

* * * * *